United States Patent [19]

Dorleans

[11] Patent Number: 4,852,667

[45] Date of Patent: Aug. 1, 1989

[54] PRESSURE RELIEF PROCESS FOR WELL-DRILLING

[75] Inventor: Andre M. Dorleans, Le Perray-En-Yvelines, France

[73] Assignee: TOTAL Compagnie Francaise des Petroles, Paris, France

[21] Appl. No.: 66,599

[22] Filed: Jun. 26, 1987

[30] Foreign Application Priority Data

Jul. 2, 1986 [FR] France ..... 86 09589

[51] Int. Cl.[4] ..... E21B 7/00; E21B 10/60

[52] U.S. Cl. ..... 175/65; 175/100; 175/324; 175/339; 175/393

[58] Field of Search ..... 175/215, 65, 213, 100, 175/339, 340, 393, 324

[56] References Cited

U.S. PATENT DOCUMENTS

| | | | |
|---|---|---|---|
| 2,946,565 | 7/1960 | Williams | 175/65 |
| 4,022,285 | 5/1977 | Frank | 175/65 |
| 4,223,747 | 9/1980 | Marais | 175/65 |
| 4,372,399 | 2/1983 | Cork | 175/65 |
| 4,475,603 | 10/1984 | Hayatdavoudi | 175/65 |
| 4,488,607 | 12/1984 | Hayatdavoudi et al. | 175/65 |
| 4,630,691 | 12/1986 | Hooper | 175/65 |
| 4,633,958 | 1/1987 | Mouton | 175/65 |
| 4,688,650 | 8/1987 | Hayatdavoudi et al. | 175/65 X |

OTHER PUBLICATIONS

Streeter and Wylie, "Fluid Mechanics", 6th Edition, 1975, pp. 134–139.

*Primary Examiner*—Bruce M. Kisliuk

*Attorney, Agent, or Firm*—Sughrue, Mion, Zinn, Macpeak and Seas

[57] ABSTRACT

A drill string has a bulge equipped with a system of n injection ducts connecting the interior of the string surrounding annular space and opening upwardly into the space to divert a part of the drilling fluid supplied to the bit. This arrangement makes it possible to produce below the bulge a pressure decrease H markedly greater than 10 meters of water by setting the flow of drilling fluid in the system of injection ducts at a value, expressed in $m^3/s$, equal to approximately: $\sqrt{10H \times S \times s33\ n}$, S and s being the cross-sections, expressed in $m^2$, respectively, of a part of the portion of the annular space included between the periphery of the bulge and the drill string and of the group of n injection ducts.

2 Claims, 4 Drawing Sheets

PRESSURE RELIEF PROCESS FOR WELL-DRILLING

BACKGROUND OF THE INVENTION

The invention relates to a well-drilling process.

It is known that it would be advantageous to reduce the pressure exerted on a formation during drilling in order to increase the rate of penetration of the drill bit. A requirement may also exist to discharge a small quantity of effluent through a formation during drilling, in order to analyse this effluent without interrupting the drilling. When passing through a loss zone during a drilling operation, a pressure relief in line with this zone would make it possible to continue the drilling in practice without slowing down the drilling operation.

For this purpose, it has already been proposed to divert directly upwards into the annular space included between the well and the drill string, at a certain injection depth, a part of the drilling fluid which travels down in the bore of the drill string and the remainder of which cools the drill bit, cleans the working face and lifts the cuttings to the surface through the annular space, mixing with the portion which is diverted above this injection depth.

However, attempts to employ this process for relieving the drilling fluid pressure locally have not so far met with success, the pressure relief produced failing to reach even a pressure of 10 meters of head of water.

The systematic tests which have led to the present invention have shown that, below a certain threshold flow of drilling liquid injected direclty into the annular space, the pressure-relieving effect was small and showed no or hardly any increase with the injected flow, and was incapable of exceeding 10 meters of head of water, but that, above this threshold, an increase in the injected flow produced a rapid increase in the pressure difference obtained below the injection depth, it being possible for this pressure difference to reach more than 260 meters of head of water.

It is believed that this phenomenon can be explained by the coupling of two effects: a suction effect which is observed at flows below the threshold, and which is very limited, and a thrust effect which appears only above this threshold, but which very rapidly becomes predominant and continues to increase rapidly as the flow is increased.

The earlier failures of attempts to relieve the drilling fluid pressure in the annular space are thus attributed to the ineffectiveness of an increase in flow in the range of flows which have been tried, which did not provide encouragement for the experiments to be continued and did not make it possible to discover that, above a certain threshold flow, things suddenly improved, and that it was possible to obtain very large pressure reliefs.

The thrust effect may be promoted by the fact that the drilling fluid is generally a non-newtonian fluid and that the liquid stream injected upwards into the annular space widens out rapidly and exerts its thrust on a large cross-section in the annular space. On the other hand, this behaviour of the liquid has the disadvantage of making any calculation highly complicated. An approximate mathematical formula based on the experimental results has, nevertheless, been investigated, enabling these results to be accounted for approximately, as long as the pressure relief exceeds 10 meters of head of water, and making it possible to specify the required flow adjustment.

SUMMARY OF THE INVENTION

According to the invention, there is provided a well-drilling process using a drill string carrying a drill bit at its lower end and comprising, above the drill bit, an enlargement provided with a system of n injection ducts connecting the interior of the drill string to the annular space between the well and the drill string and opening upwardly into the annular space, the injection ducts diverting into the annular space a part of the drilling fluid flowing downwardly in the drill string, the remainder of the drilling fluid flowing to the drill bit, from where it passes into the annular space, wherein the flow Q of drilling fluid to the system of injection ducts, expressed in $m^3/s$, is selected to provide a difference H, expressed in meters of head of water, in the pressure in the drilling fluid below the enlargement relative to the pressure of the drilling fluid at this level in the absence of the injection ducts, which is greater than 10m, substantially in accordance with the equation $$Q=\sqrt{10H\times S\times s\times n}$$

where S and s are the cross sections, expressed in $m^2$, respectively of the annular space above the enlargement between an imaginary cylinder extending the periphery of the enlargement and the drill string, and of the injection ducts, and 10 is an approximate value of the gravitational acceleration in $m/s^2$.

The flow in the system of injection ducts is not measured directly, but is deduced from the total flow of drilling fluid entering the drill string at the surface, the distribution of this total flow between the flow diverted for the direct injection into the annular space and the flow which reaches the drill bit resulting from the geometrical sizes of the system of injection ducts and of the system of ducts feeding the drill bit.

It has been found advantageous to employ a drill string in which the enlargement has a maximum external diameter d relatively close to the well diameter D, the ratio d/D being at least equal to 0.88.

BRIEF DESCRIPTION OF THE DRAWINGS

Embodiments according to the invention will now be described, by way of example only, with reference to the accompanying drawings. In the drawings.

DETAILED DESCRIPTION OF THE PREFERRED EMBODIMENTS

Figure 1:
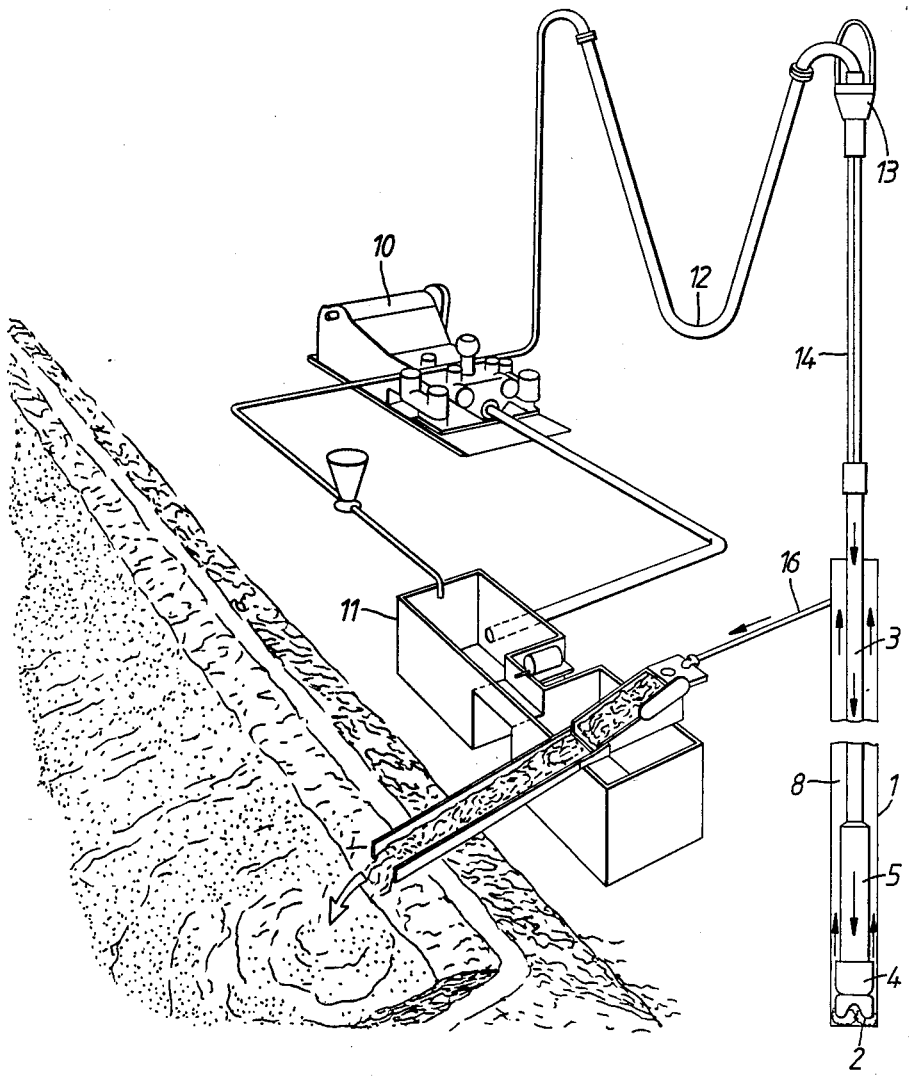
FIG. 1 shows, highly diagrammatically, a drilling fluid circulation plant employed in a well-drilling operation.

FIG. 1 shows a well 1 being drilled with a drill bit 2 secured to the bottom of a drill string 3 with the insertion of a coupling 4 between the drill bit and the drill collars 5 of the drill string. The coupling 4 forms a radial enlargement or bulge of maximum diameter d and is equipped with a plurality of, e.g. three, injection ducts 6 of which one is visible in FIG. 2, and which start from the bore 7 of the drill string and open axially upwardly into the annular space 8 between the well 1 and the drill string, via nozzles 9. Drilling fluid is drawn by pumps 10 from a suction pit 11 and conveyed through a flexible pipe 12 and a rotary joint head 13 into the bore of the kelly bar 14 and of the drill string. The drilling fluid thus introduced into the bore 7 of the drill string flows downwardly to the coupling 4 in which the stream of drilling fluid divides into a first portion which is diverted upwards, via the injection ducts 6 and the nozzles 9, into the annular space 8, and a second portion which continues to flow downwardly to the drill bit 2 through a single nozzle 15 and then travels back up in the annular space around the drill bit 2 and the coupling 4, being entrained above the coupling 4 by the drilling fluid from the nozzles 9. The drilling fluid leaves the annular space 8 through a bell nipple 16 (FIG. 1).

Figure 2:
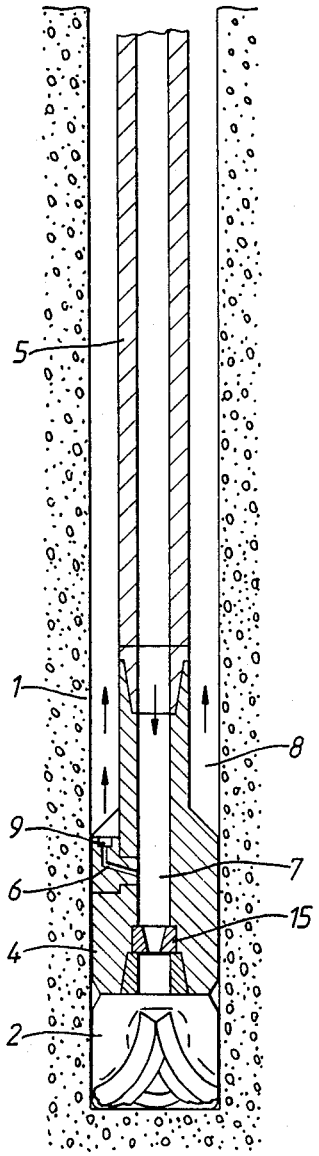
FIG. 2 shows, on a larger scale, a vertical section through the lower part of the well of FIG. 1, showing a drill bit and an enlargement equipped with a system of injection ducts.
Figure 3:
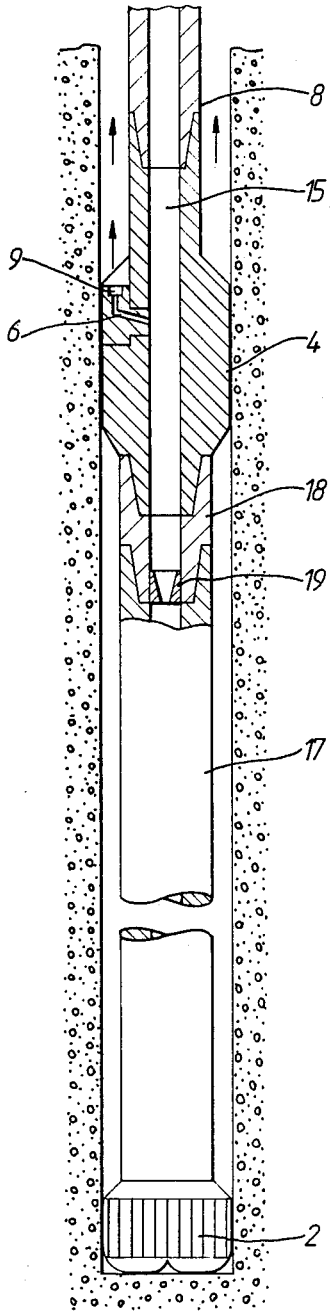
FIG. 3 is a view similar to that of FIG. 2 in which a drilling turbine or a core drill bit is employed.

FIG. 3 shows an alternative form of mounting of the enlargement 4 which is no longer placed directly above the drill bit but which is separated from it by a drilling turbine or a core drill bit 17. In such a case, a nozzle-carrier coupling 18 is provided, in which a single nozzle 19, similar to the nozzle 15 in FIG. 2, is fitted.

Figure 4:
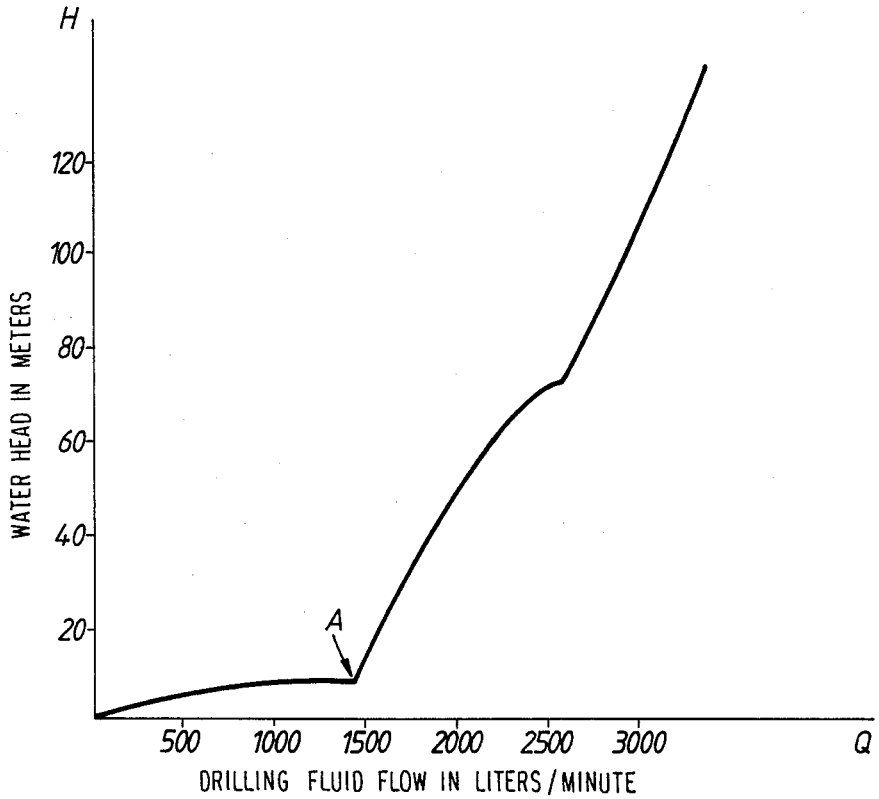
FIG. 4 shows a plot of the pressure difference H as a function of the flow Q.

FIG. 4 shows a graph produced by plotting the pressure differences H, expressed as meters of head of water, as a function of the flow Q expressed in litres/ minute, in the group of nozzles. The flow Q is deduced from the flow measured at the delivery of the pumps 10, as was stated earlier, while the pressure differences H are the differences between the pressure measured below the coupling 4 before any circulation of drilling fluid and the pressures subsequently measured below the coupling 4 at increasing flows Q. This graph corresponds to test No. 5 in the table which follows, which shows the results of nine tests carried out in a well 1 of diameter D=31.11 cm with a drill string 3 of diameter d'=12.70 cm and a radially enlarged coupling 4 of diameter d=28.57 cm, equipped with three similar nozzles but of diameters which differ from one test to another, the flow QA in litres/minute and the pressure difference HA as the head of water for the threshold defined by the point A in Figure 4, together with, in the same units, the maximum pressure difference HM obtained during each test and the corresponding flow QM.

| Test No. | Nozzle diameter in cm | QA | HA | QM | HM |
|---|---|---|---|---|---|
| 1 | 0.64 | 600 | 9.2 | 1200 | 49 |
| 2 | 0.72 | 700 | 8.5 | 1465 | 51 |
| 3 | 0.80 | 870 | 9.1 | 1785 | 83 |
| 4 | 0.88 | 1010 | 9.5 | 2250 | 113 |
| 5 | 0.95 | 1150 | 9.8 | 2590 | 143 |
| 6 | 1.03 | 1200 | 9.9 | 2960 | 176 |
| 7 | 1.11 | 1250 | 9 | 3370 | 190 |
| 8 | 1.19 | 1300 | 9.2 | 3730 | 279 |
| 9 | 1.27 | 1350 | 9.2 | 3975 | 261 |

This table shows the magnitude of the pressure difference which it is possible to obtain when the threshold A has been exceeded. The graph in FIG. 4, which corresponds to test No. 5 is similar to the graphs which were obtained in the case of the remaining eight tests. It shows that below the point A, the pressure differences H which are obtained show very little increase when the flow Q is increased. The pressure difference H below the point A never exceeded 10 meters of water. On the other hand, as soon as the threshold of the point A is crossed, the pressure differences H increase rapidly when the flow Q increases and can reach high values.

Figure 5:
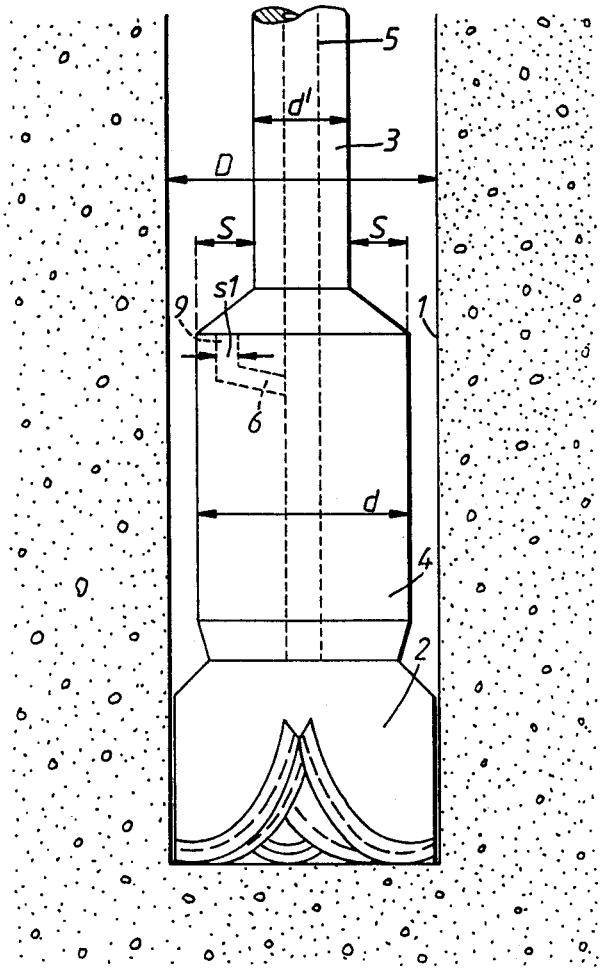
FIG. 5 is a diagrammatic illustration of a portion of the drill string with an enlargement with injection ducts, permitting the quantities considered in the description to be clearly seen.

FIG. 5 shows the diameters D, d, d' referred to above and the cross-section S, referred to above, is shown together with the cross-section sl of a nozzle, the cross-section s referred to above being equal to n×sl, n being the number of ducts 6 provided.

The drilling process just described makes it possible to produce locally, in the course of drilling, any required pressure relief which can be of use in practice, for example for crossing a loss zone, the coupling 4 being then placed higher along the drill string, for drilling a hard rock, for withdrawing a sample of effluent, and the like.

What is claimed is:

1. A well drilling process using a drill string (3) carrying a dril bit (2) at a lower end thereof and comprising, above the drill bit, an enlargement (4) having a maximum external diameter smaller than the diameter of a bore hole being drilled and provided with a system of n injection ducts (6) connecting an interior (7) of said drill string to an annular space (8) between the well and said drill string and opening upwardly into said annular space, comprising the steps of:

(a) pumping drilling fluid downwardly through the interior of said drill string, (b) diverting a portion of said drilling fluid into said annular space via said injection ducts, the remainder of said drilling fluid flowing downwardly to said drill bit from where it passes upwardly around an exterior of said enlargement and into said annular space, and (c) selecting the flow Q of said diverted portion of drilling fluid, expressed in $m^3/s$, to provide a difference H, expressed in meters of head of water, in the pressure of the drilling fluid below said enlargement relative to the pressure of said drilling fluid at a level of said enlargement in the absence of said injection ducts, greater than a threshold value of H=10 m, and substantially in accordance with the equation:

$$Q=\sqrt{10H\times S\times s\times n},$$

wherein s and S are respective cross-sections, expressed in $m^2$, of an annular space above the enlargement between an imaginary cylinder extending an outer periphery of the enlargement upwardly and the drill string, and of the injection ducts, and 10 is an approximate value of gravitational acceleration in $m/s^2$.

2. A process according to claim 1, wherein the well has a diameter D, and further comprising the step of selecting the maximum external diameter of said enlargement to be at least equal to 0.88D.

* * * * *